US011673039B2

(12) United States Patent
Stanek

(10) Patent No.: US 11,673,039 B2
(45) Date of Patent: Jun. 13, 2023

(54) BASE PORTION OF BINDING FOR SPLITBOARD WITH HOLDERS FOR ITS FIXATION ON SKIS

(71) Applicant: Michal Stanek, Mesto (CZ)

(72) Inventor: Michal Stanek, Mesto (CZ)

( * ) Notice: Subject to any disclaimer, the term of this patent is extended or adjusted under 35 U.S.C. 154(b) by 0 days.

(21) Appl. No.: 17/419,259

(22) PCT Filed: Mar. 5, 2020

(86) PCT No.: PCT/CZ2020/000009
§ 371 (c)(1),
(2) Date: Jun. 28, 2021

(87) PCT Pub. No.: WO2020/182235
PCT Pub. Date: Sep. 17, 2020

(65) Prior Publication Data

US 2022/0072406 A1 Mar. 10, 2022

(30) Foreign Application Priority Data

Mar. 11, 2019 (CZ) ..... CZ2019-35998 U

(51) Int. Cl.
*A63C 10/14* (2012.01)
*A63C 10/18* (2012.01)
*A63C 5/02* (2006.01)

(52) U.S. Cl.
CPC ..... *A63C 10/14* (2013.01); *A63C 10/18* (2013.01); *A63C 5/02* (2013.01); *A63C 2203/06* (2013.01)

(58) Field of Classification Search
CPC ..... A63C 10/14; A63C 10/18; A63C 5/02; A63C 2203/06; A63C 5/031; A63C 9/0807; A63C 10/28; A63C 9/08; A63C 2203/10
See application file for complete search history.

(56) References Cited

U.S. PATENT DOCUMENTS 6,206,402 B1 * 3/2001 Tanaka ..... A63C 10/10 280/607
7,823,905 B2 * 11/2010 Ritter ..... A63C 10/14 280/14.26

(Continued)

FOREIGN PATENT DOCUMENTS

CZ 32787 U1 4/2019
DE 19700291 A1 7/1998

(Continued)

OTHER PUBLICATIONS

Video: Enfuse Brand—El Stylo Splitboard Binding; https://www.youtube.com/watch?v=VdaDXnsRg7w; Jan. 27, 2020.

(Continued)

*Primary Examiner* — James A Shriver, II
*Assistant Examiner* — Michael T. Walsh
(74) *Attorney, Agent, or Firm* — Bryant J. Keller; Kirton McConkie

(57) ABSTRACT

A flat board as a base plate of a binding for splitboards with holders for the bindings' fixation on skis that are joined together to form a snowboard that has a circular slit (or opening) formed in a central part of the board. The circular slit is equipped with a perimeter recess for removable fixation of a contact ring which is, on its inner perimeter, equipped with two pairs of opposed dents (or indentations) that are designed for connection with a holder. The contact ring is also modified between the dents (or indentations) for insertion of end pins of a locking eccentric. The locking eccentric is formed by an axial shaft with end pins protruding from end hubs formed at both ends of the axial shaft.

14 Claims, 6 Drawing Sheets

(56) References Cited

U.S. PATENT DOCUMENTS

| | | | | |
|---|---|---|---|---|
| 9,884,243 | B2 | 2/2018 | Wariakois | |
| 10,035,058 | B1 | 7/2018 | Ritter | |
| 2009/0273163 | A1* | 11/2009 | Sorenson | A63C 10/28 280/628 |
| 2010/0109289 | A1* | 5/2010 | Wischhusen | A63C 10/14 280/613 |
| 2012/0274036 | A1 | 11/2012 | Kloster et al. | |
| 2013/0341889 | A1* | 12/2013 | Neubauer | A63C 9/02 280/607 |
| 2014/0210187 | A1 | 7/2014 | Ritter | |
| 2015/0014962 | A1* | 1/2015 | Rayner | A63C 10/18 280/611 |
| 2017/0189788 | A1 | 7/2017 | Wariakois | |
| 2020/0346097 | A1* | 11/2020 | Kloster | A63C 10/02 |

FOREIGN PATENT DOCUMENTS

| | | | | |
|---|---|---|---|---|
| DE | 102013007797 | A1 * | 11/2014 | A63C 10/14 |
| JP | 4081505 | B1 * | 4/2008 | A63C 10/14 |
| KR | 20080012245 | A * | 2/2008 | |
| WO | 2014007658 | A1 | 1/2014 | |
| WO | 2018138052 | A1 | 8/2018 | |

OTHER PUBLICATIONS

Collins, Paul K.; Leen, Robert; Alvarez, Clara Usma; User Centric Design, Data Analysis and Performance of Snowboard Bindings; Procedia Engineering vol. 147, 2016, pp. 437-442, E-ISSN: 1877-7058 https://www.sciencedirect.com/science/article/pii/S1877705816307846?via%3Dihub; July 9, 2016.

* cited by examiner

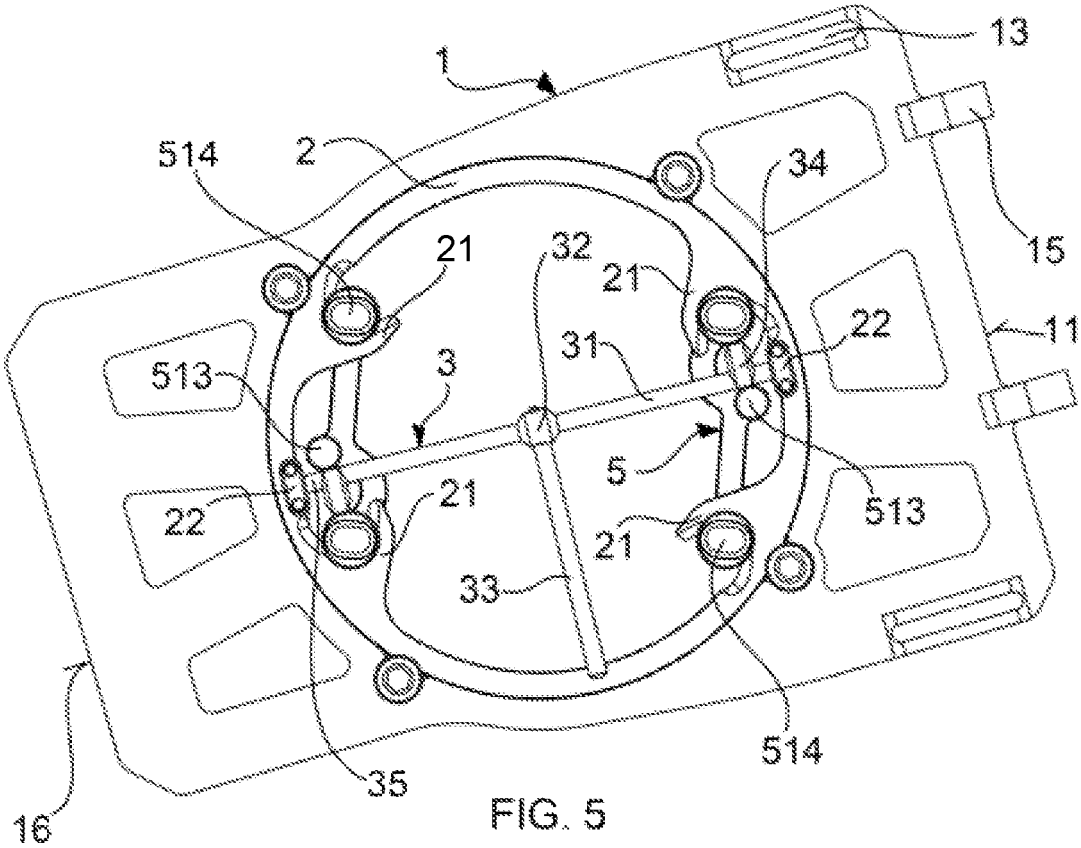
FIG. 5
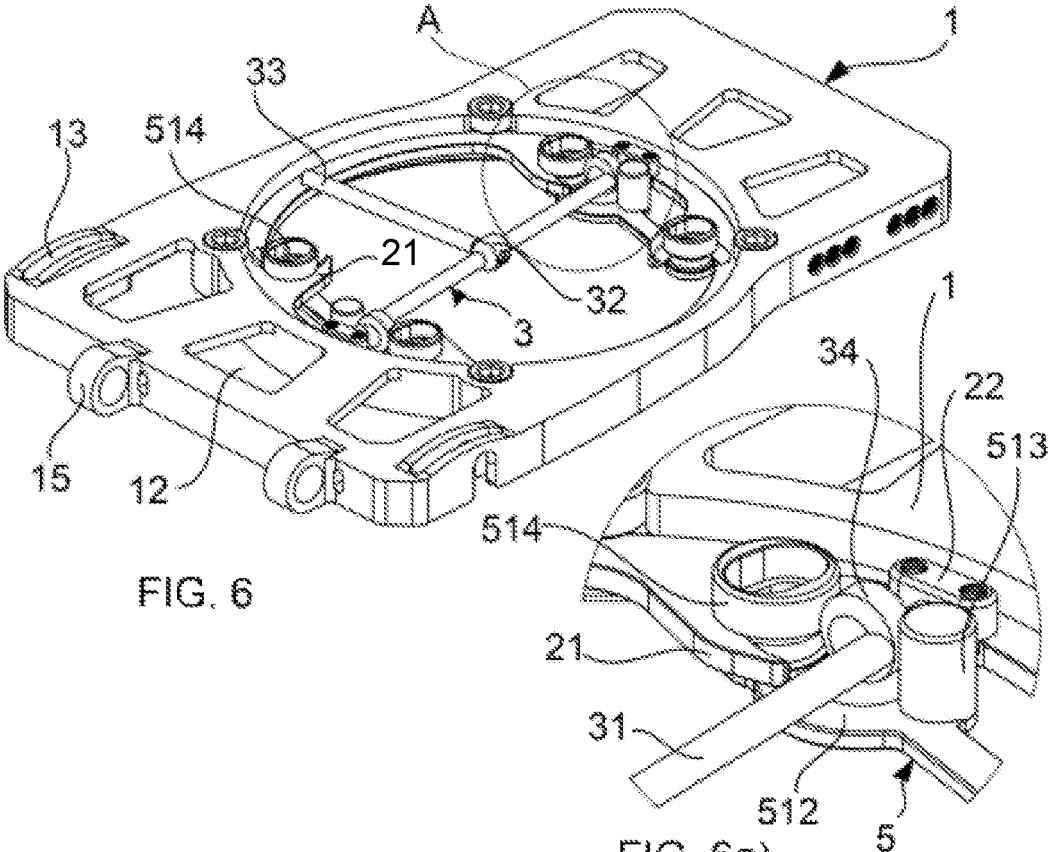
FIG. 6
FIG. 6a)

BASE PORTION OF BINDING FOR SPLITBOARD WITH HOLDERS FOR ITS FIXATION ON SKIS

FIELD OF INVENTION

The invention relates to equipment used for the pursuit of winter sports. More specifically, the invention relates to construction of a base portion of a binding for a splitboard with holders for its fixation on skis, which enables easy fastening of the skis together to have them be formed into a shape of snowboard and unfastening to allow the skis to be used separately for skiing.

BACKGROUND

In recent years, there has been a massive spread, not only of snowboarding but, also of splitboarding, which is based on use of a snowboard that is divided lengthwise into two boards (or skis) such that it is possible to use them connected for a downhill ride, and when they are divided, they can be used in an uphill ascent (as classic hiking skis (or as cross-country skis) in a similar way as skialp). For performance of these alternative functions, it was necessary to modify the classic snowboard binding to enable it for easy modification for various modes of ride and to complete it with other functional elements, which would enable easy connection and disconnection of a snowboard board into two separate boards (or skis) and also would provide a safe fixation of a base portion of the binding for both modes of use.

Many systems have been invented and operated to allow for construction and locking of a base portion of a binding and whose designs were described, for example, in U.S. Pat. No. 7,823,905, U.S. Ser. No. 10/035,058, U.S. Pat. Pub. No. US2014/0210187, U.S. Pat. Pub. No. US2012/274036, U.S. Pat. Pub. No. US2015/014962, WO2018138052, U.S. Pat. Pub. No. US2013/341889, or U.S. Pat. No. 9,884,243. Some of these solutions have quite structurally complicated fixation systems that include the use of many movable parts whose functionality can get worse when such parts are frozen or clogged with snow. Other systems with simple structure are more demanding for manipulation and their functionality can also get worse when they are frozen or clogged with snow.

An aim of the present design is to introduce a new conception of a base portion of a binding for a splitboard having holders for the binding's fixation to skis using a simple structure that enables an easy change of various modes of use, namely an ascending mode (in which the splitboard is split into two skis and is used for uphill climbing by the help of climbing skins (strips of material attached to the skis' undersides to provide traction) and in which the a tip of the biding is pivotally fixed to a corresponding ski), and a snowboarding mode (in which the skis are connected together into one snowboard and in which the binding is used as a classic snowboard binding). The described system of fastening and unfastening the base portion is functionally reliable, in comparison with many known solutions and is much more resistant against clogging with snow and freezing, while also providing a high level of comfort for its user.

SUMMARY OF THE INVENTION

A defined goal is achieved with an invention which is a base portion of a binding for a splitboard with holders for the binding's fixation on a ski that can be connected to another ski to form a snowboard, wherein the base portion is formed by a flat board whose front face is modified for fixation to a front caliper for climbing mode, wherein a useful portion of the invention is that in the central part of the board is formed a circular slit (or opening) that is equipped with a perimeter recess on which is embedded and removably connected a contact ring, which is, on its inner perimeter, equipped with two couples (or pairs) of opposed dents (or indentations) that are designed to be connected with a holder, whereas between the dents (or indentations) the ring is modified for insertion of end pins having a locking eccentric, which is formed by an axial shaft that is modified for a 180° flip over, whereas both end parts of the axial shaft comprise end hubs from which are, in a collinear way with the axial shaft, positioned the end pins.

In an advantageous design, there are on the ring, between the dents (or indentations), fixed flanges, whereas a size of horizontally situated openings of the flanges corresponds with a diameter of the end hubs of the locking eccentric, wherein there is, in the central part of the shaft, formed a fixating collar in which is, in a perpendicular direction to an axis of the shaft, fixed a shifting lever, whose length corresponds with a radius of the circular slit, and wherein the end pins of the locking eccentric are on the shaft positioned opposite to each other or co-directionally.

Likewise, it is advantageous when the holders for fixation of the board to the skis when the skis are connected in a snowboard mode are formed by a solid flat latch that includes a long arm and a short arm to which is fixed a positioning pin, wherein the end parts of the shoulders are fixed support pivots, which are placed in the way, that during turning of the locking eccentric is ensured contact between the end hubs and the support pivots of the short arm and also the positioning pins, whereas a smallest distance between the support pivot of the short arm and the positioning pin corresponds at least with a diameter of the end hub of the locking eccentric.

With this new design of the base portion, and the holders for the base portion's fixation to skis, some embodiments of the described invention can achieve a higher efficiency in that such embodiments enable a simple setting of the base portion on a joined splitboard with a simple locking simply by turning a lever of the locking eccentric from one position into another by rotation of the locking eccentric.

DESCRIPTION OF ENCLOSED DRAWINGS

Particular examples of various designs of the invention are schematically illustrated in the enclosed drawings where:

Figure 3A:
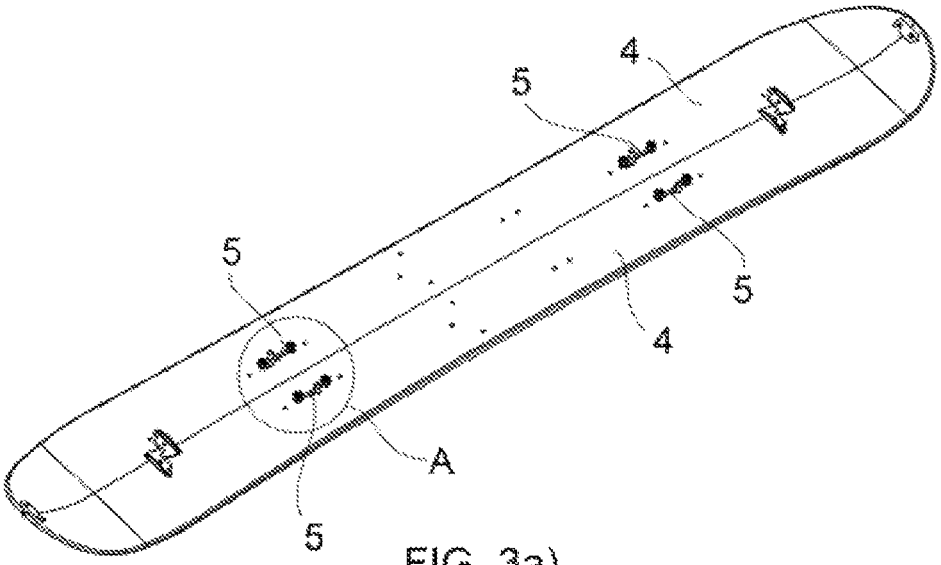

FIG. 3*a*) is a perspective view of a splitboard with holders on both skis.

Figure 3B:
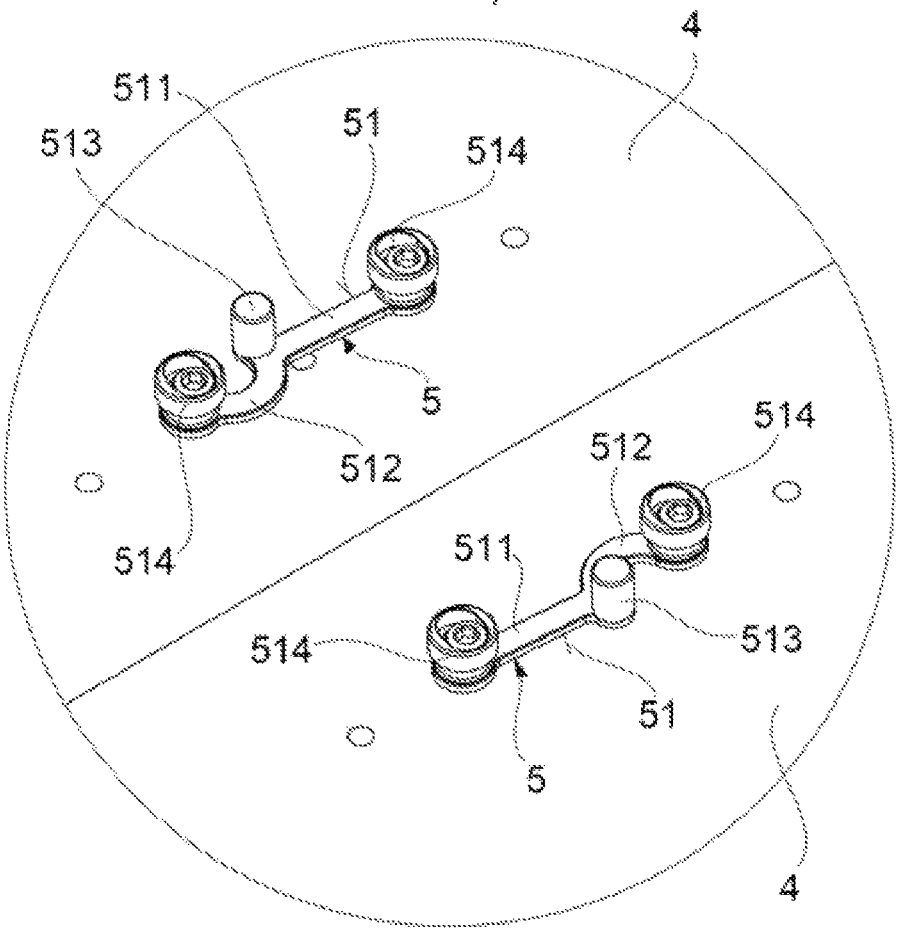

FIG. 3*b*) is a perspective view of the holders of the base portion.

Figure 4A:
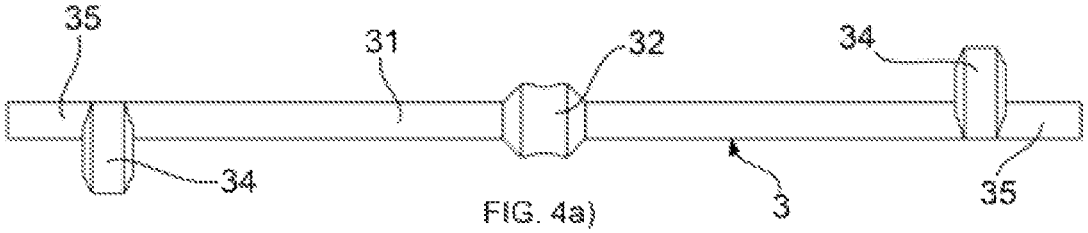
Figure 4B:
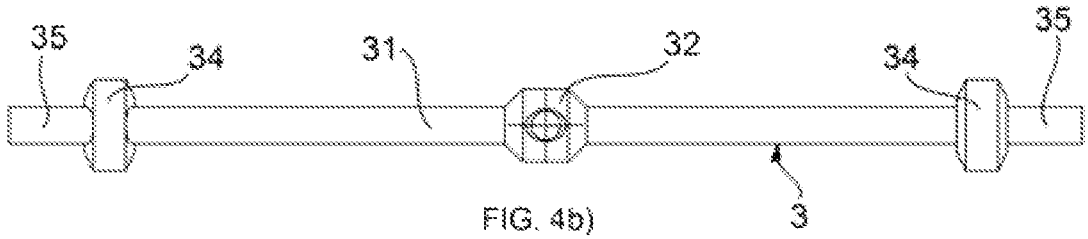

FIG. 4*a*) is a plan view of a locking eccentric,

FIG. 4*b*) is a side view of the locking eccentric.

Figure 4C:
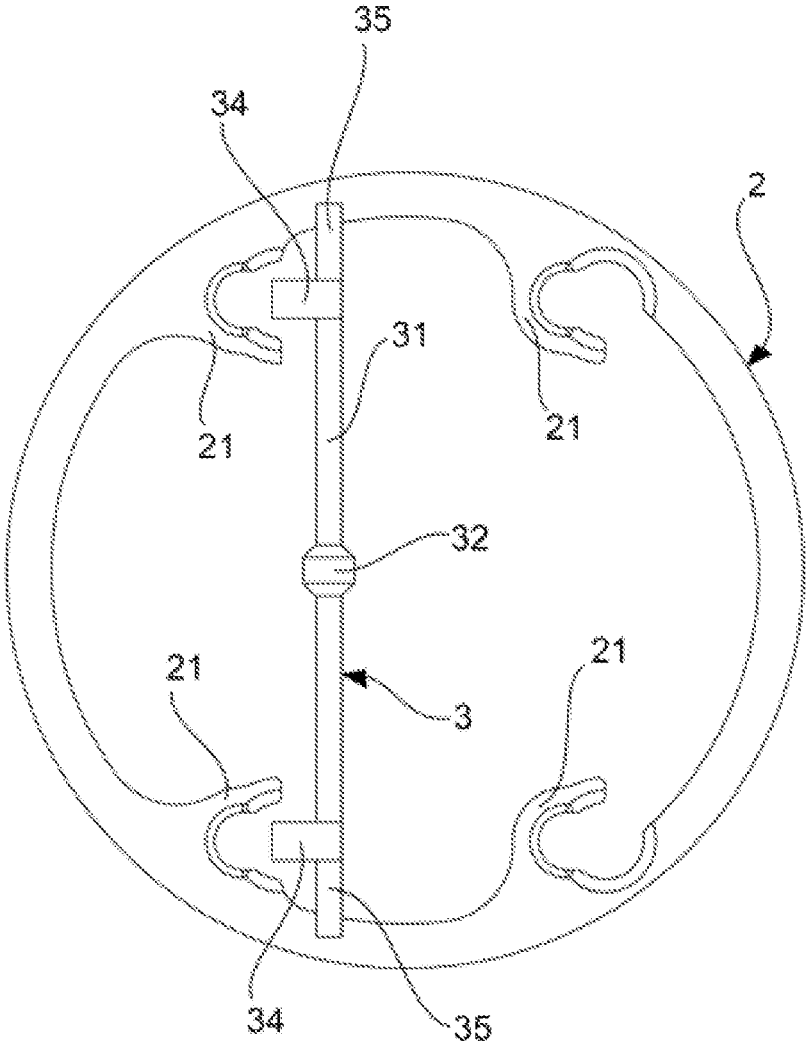

FIG. 4*c*) is a view of an alternative design of the locking eccentric with the locking eccentric being set in a contact ring.

Figure 7:
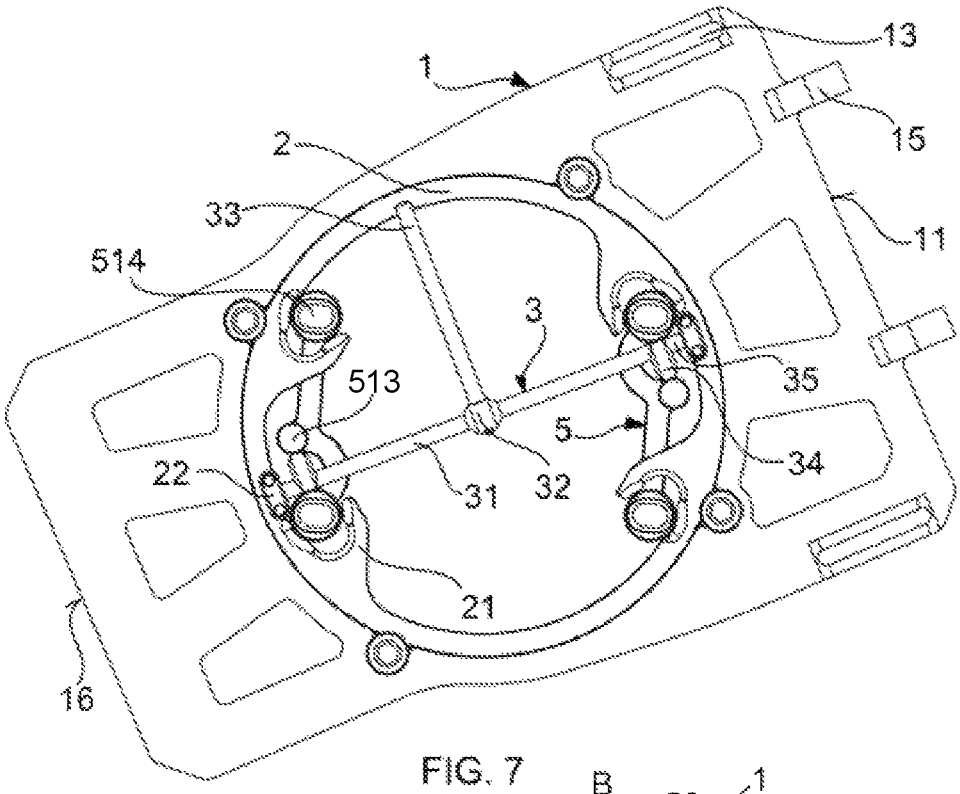

FIG. 5 is a view from above the base portion, with the base portion fixed in a holder, when the locking eccentric is in a locked position for a snowboard mode, FIG. 6 is perspective view of the base portion from FIG. 5, FIG. 6*a*) is a detail A of an end part of the locking eccentric in a locked position from FIG. 6, FIG. 7 is a view from above of the base portion, when the locking eccentric is in an unlocked position during modification to an ascending mode.

Figure 8A:
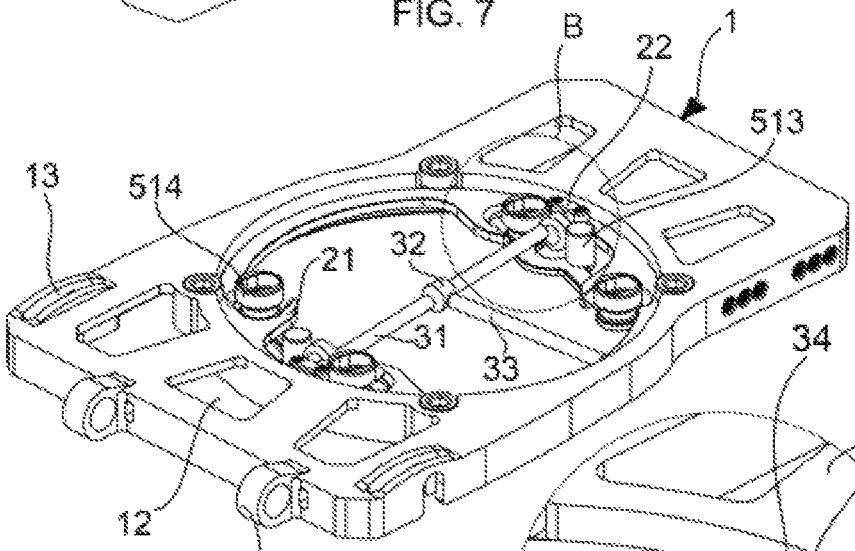

FIG. 8*a*) is a perspective view of the base portion from FIG. 7, and

Figure 8B:
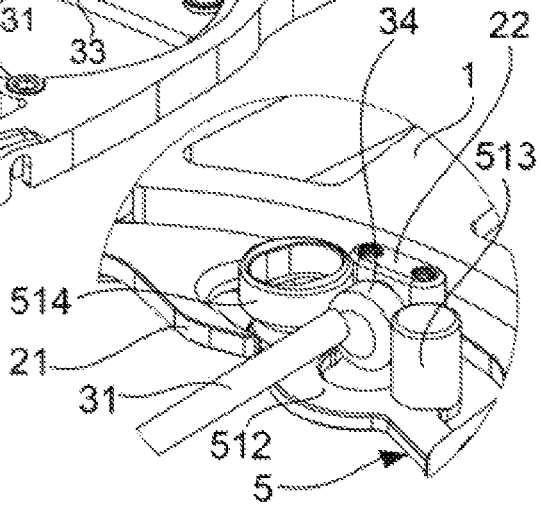

FIG. 8*b*) is a detail B of the end part of the locking eccentric in an unlocked position from FIG. 8*a*).

The drawings which illustrate embodiments of the introduced invention do not, in any case or in any way limit the extent of the protection stated in the claims, yet merely clarify various aspects of the invention.

EXAMPLES OF DESIGN OF THE INVENTION

Figure 1:
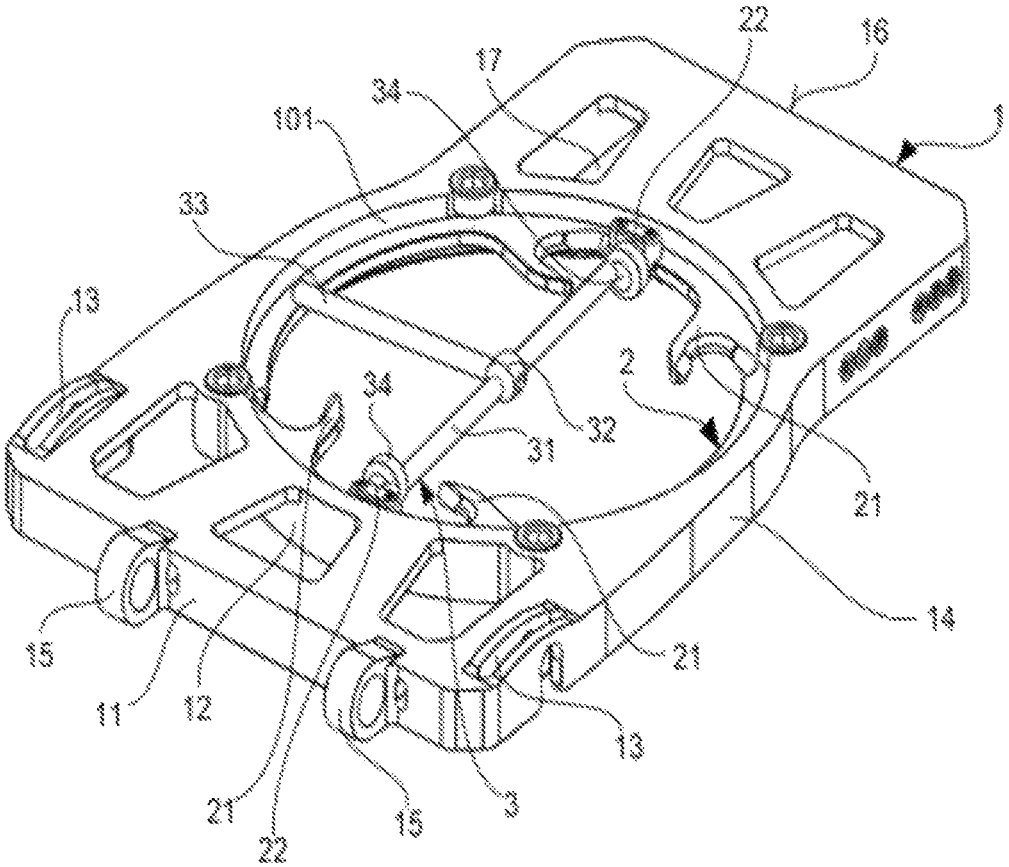
FIG. 1 is perspective view of a board of a base portion.
Figure 2:
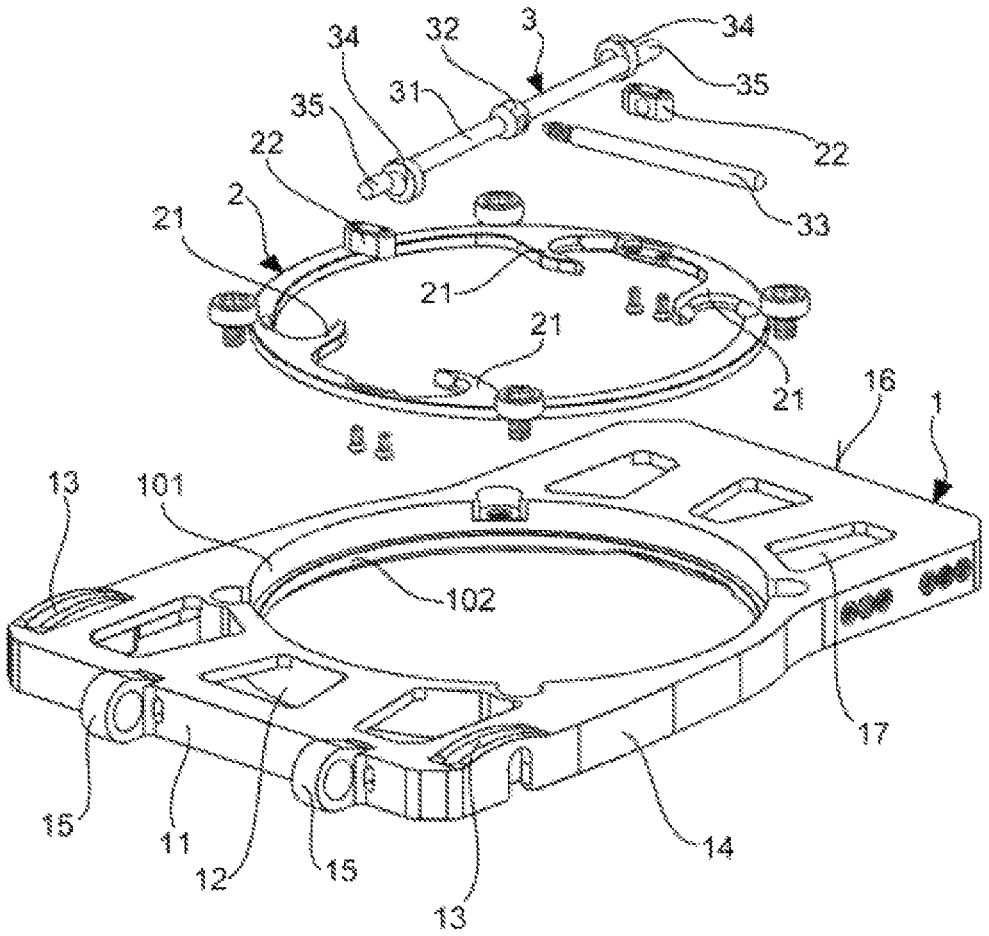
FIG. 2 is an exploded view of the board from FIG. 1.

The base portion illustrated in FIG. 1 and FIG. 2 is formed by a substantially rectangular flat board 1, in whose central part is made a circular slit (or opening) 101, which is, in its lower part, equipped with a perimeter recess 102, in which is selectively coupled (in a selectively removable manner), by the help of non-illustrated screws, a contact ring 2. The contact ring 2 is, on its inner perimeter, equipped with two couples (or pairs) of opposed dents (or indentations) 21, between which are fixed flanges 22, which are configured to respectively receive an end pin 35 of a locking eccentric 3. The locking eccentric 3 is formed by an axial shaft 31, in whose central part is formed a fixing collar 32, in which is (in a perpendicular direction to an axis of the axial shaft 31) fixed, preferably screwed on, a shifting lever 33, whose length corresponds with a radius of the circular slit (or opening) 101, and by this is provided with an ability to contact its end part with a surface of the contact ring 2. At each end of the axial shaft 31 is formed an end hub 34, with the two end hubs 34 being disposed opposite to each other, with an end pin 35 protruding from each of the end hubs 34, in a co-linear way with the axial shaft 31, and with the end pins' 35 diameters enabling their respective insertion into the corresponding flange 22. A lower surface of the base portion is, in the area between the circular slit (or opening) 101 and a front face 11, equipped with a relieving cutout 12, which is connected with the upper surface of the board 1 with one or more non-illustrated technological openings. Furthermore, the board 1 is, in its front part, equipped with two slots 13 that are situated lengthwise with respect to one or more side plates 14, with the slots 13 being and designed for fixation of a front buckle of the binding, and wherein on the front face 11 are formed two eyes 15 that are configured to be coupled with a non-illustrated holder when the skis 1 are separated for ascending mode. In the back part of the board 1 is a lower surface of the board 1, in the area between the circular slit 101 and the back face 16 that is equipped with a relieving cutout 17, which is connected with the upper part of the board 1 by one or more non-illustrated technological openings and which is configured to support of the board 1 with a non-illustrated back brace of the binding. Finally, the side plates 14 in the back part of the board 1 are equipped with a set of tapped assembly holes 18, designed for fixation of an are strap for fixation of a back buckle and a support foot of the binding.

To provide one with the option to fix the board 1 of the base portion on the splitboard, some embodiments include holders 5, which are fixed in predetermined positions on upper surfaces of skis 4. In this regard, the holders 5 are formed with a solid flat lath 51 which includes a long arm 511 and an arched short arm 512, wherein at a coupling between the long arm 511 and the arched short arm 512 is fixed a positioning pin 513. In the end parts of the arms 511 and 512 are fixed support journals 514, which have to be on skis, for provision of a function of fixation of the binding into a snowboard mode, fixed side opposed as it is illustrated in FIG. 3. The arms 511 and 512 are then situated in the way such that the centers of the support journals 514 and the center of the positioning pin 513 are not in one line but on one circle, whereas a distance between the support journal 514 of the short arm 512 and the positioning pin 513 corresponds with a maximal width of the end hub 34 of the locking eccentric 3.

During configuration of the splitboard for the snowboard mode, both skis 4 are at first connected together by the help of central couplings and top couplings that couple the skis 4 into the shape of a snowboard board (as it is illustrated in FIG. 3*a*). Then the couple (or pair) of holders 5 are placed the board 1 such that the support journals 514 are in an area of the dents (or indentations) 21 of the contact ring 2 and the end hubs 34 are between the support journals 514 and the positioning pins 513, as it is illustrated in FIG. 7 and FIGS. 8*a*)-8*b*). Following a flip over (or rotation) of the shifting lever 33 of the locking eccentric 3 by 180° the end pins 35 are braced in the flanges 22 and simultaneously the end hubs 34 are braced against the support journals 514. Additionally, with a turn of the board 1 together with the contact ring 2 and contact of all dents (or indentations) 21 with the support journal 514, the board 1 is vertically as well as horizontally fixed to the snowboard. To release the board 1 from its position in the snowboard mode comes, after release from the binding, a flipping over of the shifting lever 33 by 180°, which thereby braces the end pins 35 in the flanges 22 and simultaneously braces the end hubs 34 against the positioning pin 513, which thereby turns the board 1 with the contact ring 2 into an initial position, which is illustrated in FIG. 7 and FIGS. 8*a*)-8*b*), which thus makes it possible to lift the base portion.

The described design is not the only possible solution according to the invention. By way of non-limiting example, some embodiments of the locking eccentric 3 have the end hubs 34 placed co-directionally to the axial shaft 31 as it is illustrated in FIG. 4*c*). It is also possible to shape the dent 21 of the contact ring 2 and the support journal 514 of the holder 5 in any manner that allows for mutual contact. Likewise, the illustrated design of the board 1 can be modified. For instance, it can be shaped and modified to different sizes of snowboard boots. Moreover, it is not necessarily important how the fixation and support elements of the base portion are designed. With fixation of all four support journals 514 and two positioning pins 513 for them to be in the same position as in the holders 5 on the skis which are configured into the snowboard form, which in a non-specified way is comparable to classic snowboard, it is noted that it is possible to use this system for connection of the board 1 with a classic snowboard.

INDUSTRIAL UTILITY

The base portion for the splitboard according to the invention is designed to offer users of sports equipment for winter sports with design features that offer a high level of operational comfort for the users, while providing easy manipulation during reconfiguration and minimization of failures of operating components.

REFERENCE NUMERALS

1 Board
101 Circular slit

102 Perimeter recessing
11 Front face
12 Front relieve cutout
13 Slot
14 Side plate
15 Eye
16 Back face
17 Back relieving cutout
18 Assembly hole
2 Contact ring
21 Dent
22 Flange
3 Locking eccentric
31 Axial shaft
32 Fixing collar
33 Shifting lever
34 End hub
35 End pin
4 Skis
5 Holder
51 Lath
511 Long arm
512 Short arm
513 Positioning pin
514 Support journal

The invention claimed is:

1. A base portion of a binding configured to be coupled to a splitboard with holders that are coupled to two skis of the splitboard with the two skis being configured to be selectively coupled together to form a snowboard, wherein the base portion of the binding comprises a flat board, wherein in a central part of the flat board is formed a circular slit which is equipped with a perimeter recess, wherein a contact ring is selectively coupled to the perimeter recess, wherein an inner perimeter of the contact ring is equipped with two pairs of opposed indentations that are each configured to be selectively coupled to a corresponding one of the holders, wherein, between the two pairs of opposed indentations the contact ring is configured to receive end pins of a locking eccentric, wherein the locking eccentric comprises an axial shaft that is configured to be flipped over by 180°, and wherein on each end of the axial shaft is formed a respective end hub, from which, in a co-linear way with the axial shaft, protrude a corresponding end pin of the end pins of the locking eccentric.

2. The base portion according to the claim 1, wherein flanges are fixed to the contact ring, with one flange being fixed between each of the two pairs of the opposed indentations, and wherein a size of a horizontally situated opening of the flanges corresponds with a diameter of the end pins of the locking eccentric.

3. The base portion according to the claim 1, wherein, in a central portion of the axial shaft, is formed a fixing collar, in which is, in a direction that is perpendicular to an axis of the axial shaft, fixed a shifting lever, whose length corresponds with a radius of the circular slit.

4. The base portion according to claim 1, wherein the end hubs on the axial shaft are placed counter directionally with each other.

5. The base portion according to claim 1, wherein, the holders are formed with a solid flat lath which includes a long arm and a short arm, wherein at a place where the long arm and the short arm join together is fixed a positioning pin, wherein an end part of the short arm and an end part of the long arm each comprise a corresponding fixed support journal, wherein each fixed support journal is placed in a respective location such that during turning of the locking eccentric contact is ensured between one of the hubs and the corresponding support journal of the short arm, wherein a shortest distance between the corresponding support journal of the short arm and a positioning pin corresponds with a diameter of a first end hub of the end hubs of the locking eccentric.

6. The base portion according to the claim 2, wherein, in a central portion of the axial shaft is formed a fixing collar, in which is, in a direction that is perpendicular to the axis of the axial shaft, fixed a shifting lever, whose length corresponds with a radius of the circular slit.

7. The base portion according to claim 2, wherein the end hubs on the axial shaft are placed counter directionally with each other.

8. The base portion according to claim 3, wherein the end hubs on the axial shaft are placed counter directionally with each other.

9. The base portion according to claim 2, wherein, the holders are formed with a solid flat lath which includes a long arm and a short arm, wherein at a place where the long arm and the short arm join together is fixed a positioning pin, wherein an end part of the short arm and an end part of the long arm each comprise a corresponding fixed support journal, wherein each corresponding fixed support journal is placed in a respective location such that during turning of the locking eccentric contact is ensured between one of the end hubs and the corresponding support journal of the short arm, wherein a shortest distance between the corresponding support journal of the short arm and a positioning pin corresponds with a diameter of a first end hub of the locking eccentric.

10. The base portion according to claim 3, wherein, the holders are formed with a solid flat lath which includes a long arm and a short arm, wherein at a place where the long arm and the short arm join together is fixed a positioning pin, wherein an end part of the short arm and an end part of the long arm each comprise a corresponding fixed support journal, wherein each corresponding fixed support journal is placed in a respective location such that during turning of the locking eccentric contact is ensured between one of the end hubs and the corresponding support journal of the short arm, wherein a shortest distance between the corresponding support journal of the short arm and a positioning pin corresponds with a diameter of a first end hub of the locking eccentric.

11. The base portion according to claim 4, wherein, the holders are formed with a solid flat lath which includes a long arm and a short arm, wherein at a place where the long arm and the short arm join together is fixed a positioning pin, wherein an end part of the short arm and an end part of the long arm each comprise a corresponding fixed support journal, wherein each corresponding fixed support journal is placed in a respective location such that during turning of the locking eccentric contact is ensured between one of the end hubs and the corresponding support journal of the short arm, wherein a shortest distance between the corresponding support journal of the short arm and a positioning pin corresponds with a diameter of a first end hub of the locking eccentric.

12. The base portion according to claim 1, wherein the end hubs on the axial shaft are placed co-directionally with each other.

13. The base portion according to claim 2, wherein the end hubs on the axial shaft are placed co-directionally with each other.

14. The base portion according to claim 3, wherein the end hubs on the axial shaft are placed co-directionally with each other.

* * * * *